US006556779B1

(12) United States Patent
Stabile

(10) Patent No.: US 6,556,779 B1
(45) Date of Patent: Apr. 29, 2003

(54) PULTRUSION PROCESS TO FORM SPECIALLY SHAPED PIECES FOR TRANSFORMING ELECTRIC CURRENT INTO DIFFUSED HEAT

(75) Inventor: Aldo Stabile, Crema (IT)

(73) Assignee: Cadif SRL, S. Giovanni Lupatoto (IT)

( * ) Notice: Subject to any disclaimer, the term of this patent is extended or adjusted under 35 U.S.C. 154(b) by 0 days.

(21) Appl. No.: 09/807,641

(22) PCT Filed: Jul. 7, 1999

(86) PCT No.: PCT/IT99/00209

§ 371 (c)(1),
(2), (4) Date: Apr. 16, 2001

(87) PCT Pub. No.: WO00/30406

PCT Pub. Date: May 25, 2000

(30) Foreign Application Priority Data

Nov. 12, 1998 (IT) ..... MI98A2455

(51) Int. Cl.[7] ..... H05B 3/36
(52) U.S. Cl. ..... 392/437; 219/541
(58) Field of Search ..... 392/435, 436, 392/432; 156/166; 219/541; 29/611

(56) References Cited

U.S. PATENT DOCUMENTS 4,207,129 A * 6/1980 Tadewald ..... 156/242
4,752,513 A * 6/1988 Rau et al. ..... 428/91
4,888,472 A 12/1989 Stitz
5,317,132 A 5/1994 Clough
5,658,481 A * 8/1997 Pfeiffer et al. ..... 219/549
6,294,768 B1 * 9/2001 Liebich ..... 219/528

FOREIGN PATENT DOCUMENTS

EP 006 567 1/1980
EP 150 448 8/1985
EP 505 936 9/1992
FR 976276 * 3/1951 ..... 392/435

* cited by examiner

*Primary Examiner*—John A. Jeffery
(74) *Attorney, Agent, or Firm*—Michael J. Striker

(57) ABSTRACT

Process for producing tubular shaped pieces (105) having a rectangular cross section of low height, to transform electric current into diffused heat, by means of pultrusion, with continuous formation, added to known reinforcing materials such as roving (60) and mats (65) of fibreglas, on one broad side of the shaped piece (105), of one or more parallel nets (72, 73) of a weft woven (80, 81) fabric made from a continuous wire (77) of highly conductive material coated with insulating material (78), connected at set intervals to devices (111, 112) of electric sockets incorporated in the plastic material (50) so that, when the shaped piece (105) is cut through at the position of the devices (111, 112) to form electric sockets, and by filling the panels with insulating foam material (145) oblong panels (116) are obtained utilizable for innumerable purpose

23 Claims, 5 Drawing Sheets

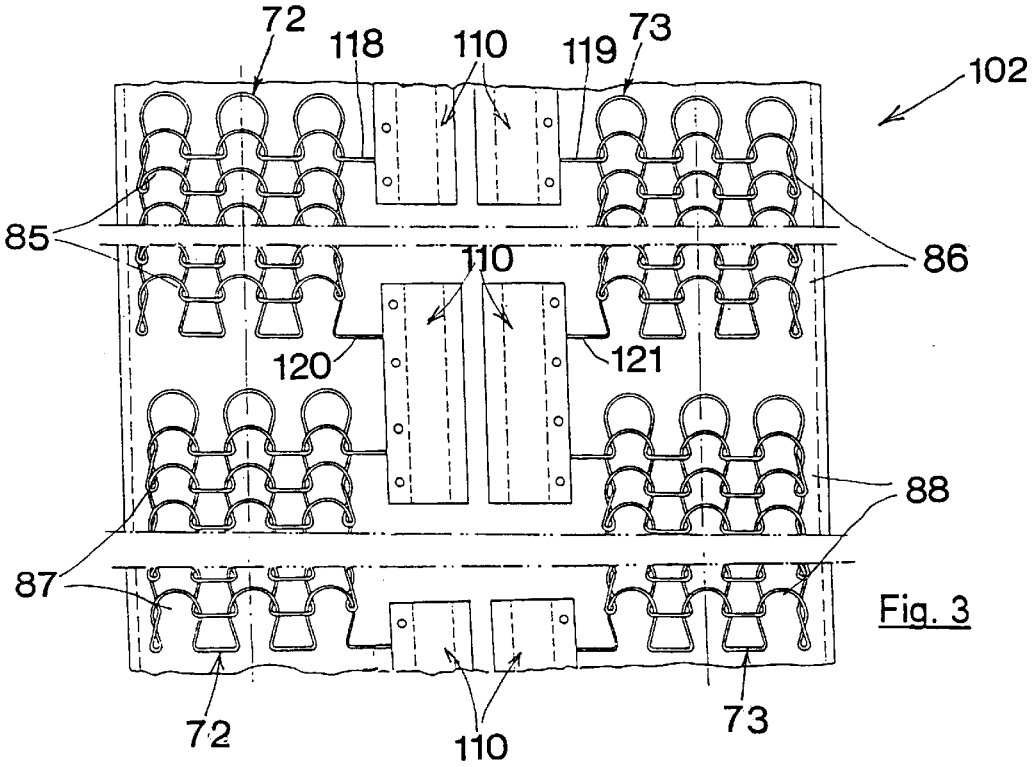
Fig. 3
Fig. 4
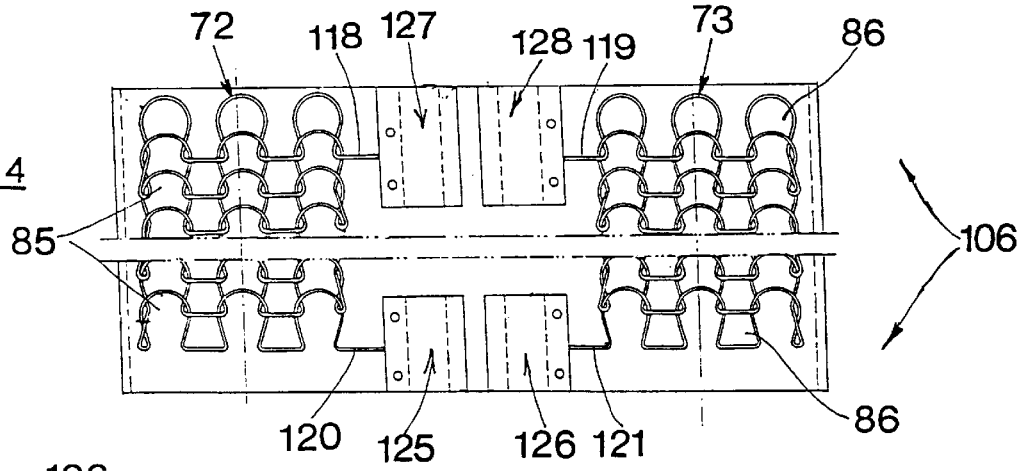
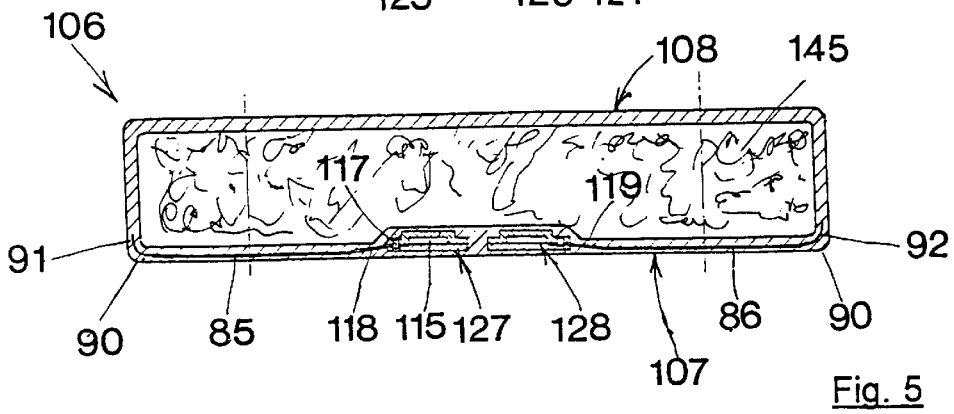
Fig. 5

PULTRUSION PROCESS TO FORM SPECIALLY SHAPED PIECES FOR TRANSFORMING ELECTRIC CURRENT INTO DIFFUSED HEAT

BACKGROUND OF THE INVENTION

The invention concerns appliances for transforming electric current into diffused heat.

The pultrusion process is well known, being one that produces parts of a certain shape possessing mechanical characteristics of a high order by pulling the reinforcing materials, known as roving and mats impregnated with thermosetting resins, through a draw bench.

The most widely used kinds of roving are glass yarns laid longitudinally to the shaped parts in order to increase their resistance to bending and pulling forces.

Mats are fibrous felts, laid out in an even manner, to improve interlaminar adhesion and make the mechanical characteristics of the material produced more homogeneous.

The polymeric matrix, consisting of thermosetting resins, may be chosen, according to the use required, from a wide range of resins, such as epoxy and phenolic or others.

The form of the parts produced through a suitable draw bench can obviously be very varied, of a solid or a tubular structure.

The pultruded part can be easily processed, bored and cut with ordinary tools, and can be joined and assembled by glueing, bolting or riveting. Polymerization takes place inside the draw bench by various processes, the most common being application of heat by electric resistances or by generation of radiofrequencies.

Purpose of the above invention is to produce pultruded shaped parts which not only possess the above characteristics but also those of generating diffused heat by transformation of electric current, with a greatly improved performance as will now be explained.

SUMMARY OF THE INVENTION

Subject of the invention is a process for producing shaped parts by pultrusion that transform electric current into diffused heat.

One or more nets, made from a continuous wire of highly conductive material coated with material of high insulating capacity, are inserted in a continuous manner in the plastic material, which nets are formed in the direction of feed of the shaped part conferring electric continuity upon it from beginning to end.

The shaped part is preferably tubular.

Tube section is preferably rectangular, low in height.

Nets are applied to one of the broad sides of the shaped part.

In one type of execution there are two nets side by side.

The two nets can be joined by an intermediate net of insulating material.

Nets are made of a weft wave material and are added to the known reinforcing materials such as continuous threads of fibreglass, or roving, and felted pieces of fibreglass, known as mats.

The matrix is of thermosetting resins of unsaturated polyesters, epoxy or phenolic resin.

The nets are put on before or after the resin bath needed for pultrusion.

Added longitudinally to the nets at fixed intervals, incorporated into the shaped part, are devices for electric sockets with a groove between them lengthwise to the shaped part.

By cutting the shaped part crosswise at the position of said devices, sockets are created for connection to a source of electricity.

In one type of execution these devices consist of a small flat plate of electrically conducting material associated to a second small plate also of electrically conducting material, with a central channel facing towards the first plate, the two being associated by rivets or the like.

The socket devices are inserted at the point where the shaped part will be cut through, thus obtaining oblong panels so that after said cut, each socket device is cut to make two such devices one being integrated into one panel and the other into the next panel.

The socket devices are placed on the central axis of symmetry of the shaped part or at its sides.

Advantageously there are two nets and the socket devices are placed in pairs, each net being connected to a socket placed at one end of the panel with a second socket placed at the other end.

Advantageously the panels are connected to electric current by two heads respectively insertible at the two ends of said panel.

One head has two contacts electrically connected internally at the two channels in the two sockets and these are at one end of the panel, while the second head has two contacts, also at the position of the channels in the two sockets, these other contacts being at the other end of the panel and connected by wires to fit a plug for an external electricity socket.

Foam material is put inside the panel to increase heat insulation so that the face of the panel opposite to that holding the electrically conducting nets remains substantially cold, both because of its distance from said net and because of the interposing insulation.

The nets are continuous in the shaped part but separated in the various preferred lengths, said lengths being connected by the socket devices. At the sides of the nets, laid in one or more units on one face of the tubular shaped part, there are lateral extensions.

The shaped parts, obtained as described, make possible formation of different objects and structural bodies of innumerable forms and characteristics.

For example, the oblong panels associated side by side, with heads at their ends, can be set up to form self-carrying walls for various uses, one side being cold and the other generating diffused warmth.

Another example is that of an oven for cooking purposes or treatment of various materials with heat emitting sides, formed of a number of panels such as those described or of a more powerful kind to create even higher temperatures if needed.

An indoor room can be easily warmed by one or more panels like the above, wall or ceiling mounted with the heat generating surface towards the environment.

The invention offers evident advantages.

In addition to their high mechanical characteristics, these pultruded parts provide the further advantage of generating diffused heat by means of electric current.

The rectangular tubular form with electric nets on one of the wider sides separated from the other by insulating material, ensures optimum generation of diffused heat from one side, the other being almost completely cold.

Realization of generators of diffused heat by a long electric lead is greatly facilitated by the net formed of highly conductive material with a coating of insulation, in loops along successive rows.

Electrical continiuity is in fact assured over the whole of the generator at whatever point the cut is made on the continuous body in which the net is inserted.

All this greatly facilitates installation in any place and in any structure as no problems of electrical or heat insulation can arise.

The shaped parts obtainable with this invention not only offer important advantages on structures and in environments generally but also enormously facilitate preparation of the structures themselves associating high structural solidity to generation of heat, for greatest user comfort.

BRIEF DESCRIPTION OF THE DRAWINGS

Characteristics and purposes of the invention will be made still clearer by the following examples of its execution illustrated by diagrammatically drawn figures.

FIG. 3 Detail of a pultruded part, plan view.

FIG. 4 Oblong panel obtained by cutting the shaped part, plan view.

FIG. 5 The panel in FIG. 3, cross section.

FIGS. 8*a* and 8*b* Detail views of FIG. 8.

FIG. 9*a* Detail view of FIG. 9.

DETAILED DESCRIPTION OF THE PREFERRED EMBODIMENTS

Figures 1, 1A, 2, 2A:
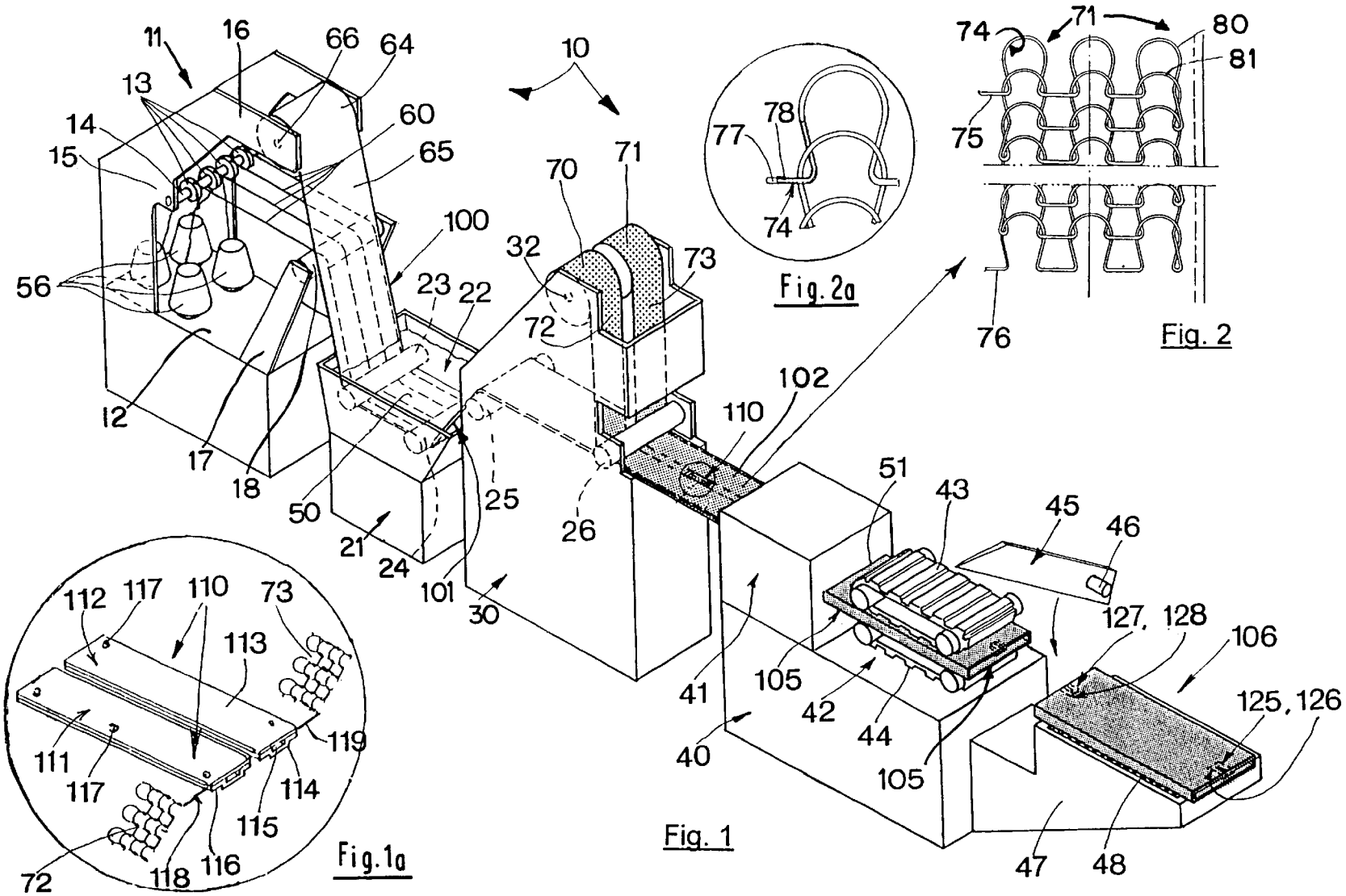
FIG. 1 Pultrusion installation for tubular shaped parts suitable for insertion of two parallel longitudinal metal nets of high electrical conductivity, and for insertion, at fixed intervals, of current devices, perspective.
FIG. 1*a* Detail view of FIG. 1.
FIG. 2 Detail of a net, plan view.
FIG. 2*a* Detail view of FIG. 2.

The installation 10 comprises a frame 11 for the reinforcing material, a stand 21 to support the bath 22 for the matrix 50 of thermosetting resin, a frame 30 to feed in a pair of copper nets 72, 73 with insulating coating, a frame 40 for the draw bench 41, for a pulling unit 42 and for the cutter 45, and the support 47 for the roller surface 48 where the cut shaped parts emerge.

The frame 11 comprises a series of reels 56 resting on the surface 12, for feeding in threads of fibreglass 60, known as roving.

Through the rear transmission formed of pulleys 13 on the shaft 14 supported by the rear ends of the frame 15 and the front transmission formed of a roller 18 supported by the front brackets 17, said roving connects with the fibreglass felt mat 65 fed in off the reel 64 that turns on the shaft 66 carried by the upper support 16.

Association between roving 60 and mat 65 produces the reinforcing band 100 that, through the transmission rollers 23, 24 is compelled to pass into the fluid matrix of thermosetting resins 50 contained in the bath 22.

On leaving said bath the band 100, guided by the rollers, is transformed into a band 101 of plastic material incorporated into which is the reinforcing material of roving and mat.

Said band 101 enters the frame 30 that carries, on shaft 32 at its top, the reels 70 and 71 of coated copper net 72 and 73; these become inserted into the band 101 so producing a band 102, complete with reinforcing material and nets, which then passes through the draw bench 41 pulled by the traction unit 42 with its upper and lower tracks 43 and 44.

At the exit 51 from the draw bench, the band 102 is transformed into a tubular shaped piece 105 which, on leaving the traction unit 42, is cut through by the cutter 45 turning on a pin 46.

As will be seen in FIG. 2, the nets are formed of a continuous wire 74 of coated copper that forms a weft weave fabric whose successive rows, like 80 and 81, are interlaced one with another.

The wire is continuous for the whole length of the net and, as may be seen in FIG. 2 for example, starts with 75 and ends with 76 without a break.

The enlarged illustration of some stitches shows that the wire 74 has a copper core 77 and insulating coating 78.

It follows that wherever the pultruded shape is cut, thus also cutting through the nets, electrical continuity is assured for the the whole length of nets between two cuts.

The detail in FIG. 1 shows that, at certain intervals and before entry into the draw bench, a pair 110 of socket devices are inserted into the band 102, each device comprising a small flat plate 113 and another small plate 144 with an axial channel 115 in it and sides 116.

The two plates 113 and 114 are associated together by rivets 117.

During association one end 118, 119 of the nets 72 and 73 is inserted between the two small plates 113, 114 of each socket device.

On the stand 47, in FIG. 1, the oblong tubular panel 106 can be seen, said panel comprising two pairs of socket devices 127, 128 and 125, 126 obtained by cutting in half the socket devices 111 and 112 already indicated.

FIG. 3 illustrates an area of a pultruded shaped part 105 comprising fractions 85, 86 and 87, 88 of the nets 70 and 71, connected to the pairs 110 of socket devices already described, by terminals such as 118, 119 and 120, 121.

FIG. 4 illustrates the composition of panels 106 obtained by cutting across the shaped part 105 at substantially half the length of the pairs 110 of socket devices so that each forms two pairs of sockets 125, 126 and 127, 128.

FIG. 5 shows the front of the panel 106 consisting of a narrow tubular shaped part with a rectangular cross section.

The positions of sockets 127 and 128 are clearly seen, and especially connection of the wire 118 in the fraction of net 85 to the socket 127 and of the wire 119 in the fraction of net 86 to the socket 128, a connection made stable by rivets 117.

Foam plastic material 145 for heat insulation is placed inside the panel. As seen in FIG. 5 the nets 72 and 73 can be extended to the corners 90 by extensions 91 and 92.

It will be clear from this figure that one side 107 of the panel will be hot due to transformation of current circulating in the nets 85, 86, while the side 108 will be completely cold both because of its distance from side 107 and because of the filling of insulating foam material 145 inside the panel.

Figure 6:
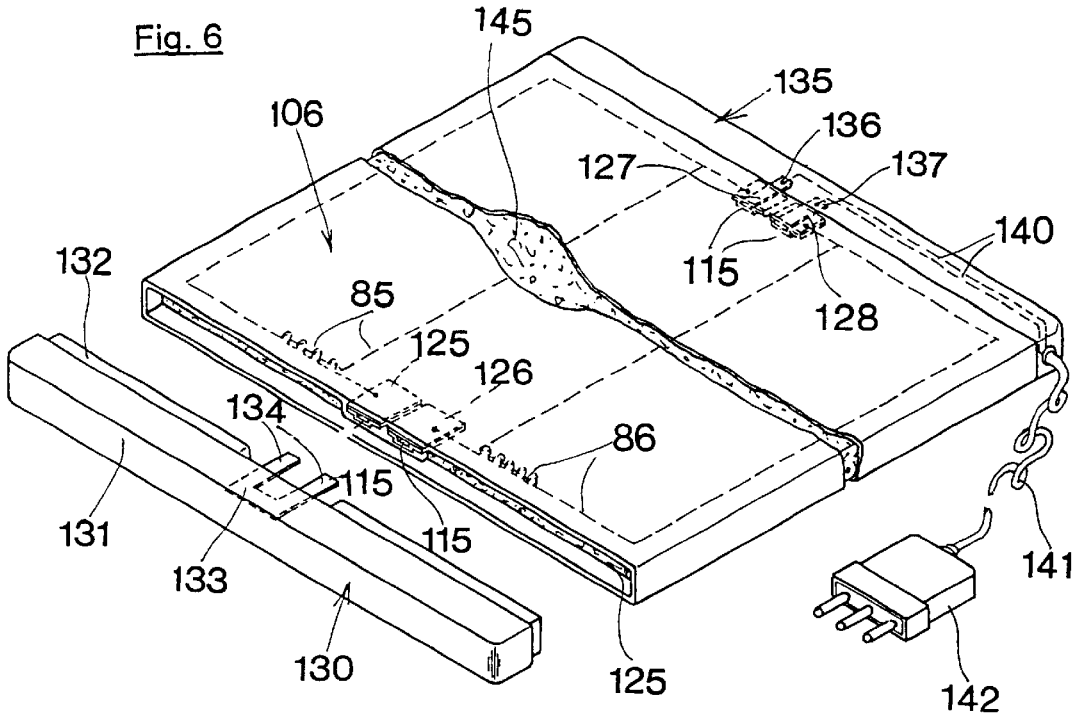
FIG. 6 Oblong panel with heads for electrical connections, with two socket devices for the two nets, placed on the axis of symmetry, seen in perspective.

FIG. 6 shows the panel 106 with nets 85 and 86, complete with heads 130 and 135.

Head 130 is formed of a bar 131 with a narrower extension 132 corresponding to the internal dimensions of the panel 106.

At the centre of said head is a two-pin copper plug 133, whose arms are sized to correspond with the dimensions of the grooves 115 in the current sockets 125 and 126 placed on the front of the panel.

The head 135, of substantially the same structure as head 130, presents contacts 136 and 137 these too able to penetrate inside the grooves 115 in sockets 127 and 128, said contacts being connected by wires 140 and 141 to the electrical socket 142.

Figure 7:
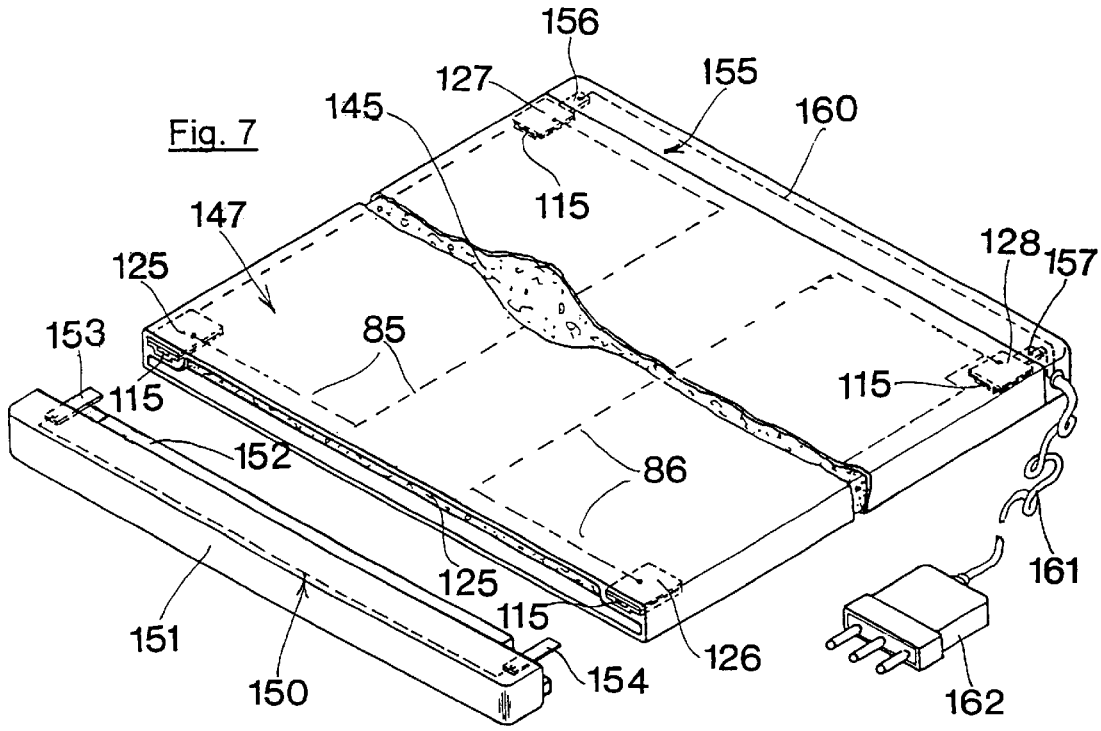
FIG. 7 As above with socket devices at the side, perspective view.

FIG. 7 shows panel 146 with nets 85 and 86, and with heads 150, 155. Head 150 is formed of a bar 151 with a narrower extension 152 corresponding to the internal dimensions of the panel 147.

At the two ends of said head are copper contacts 153 and 154 whose dimensions correspond to those of grooves 115 in the current sockets 125 and 126 placed at the sides of the panel and on its front.

The structure of head 155 is similar to that of head 150 having contacts 156 and 157, these also able to penetrate inside the grooves 115 in the sockets 127 and 128, said contacts being connected by wires 160,161 to the electric socket 162.

Figure 8:
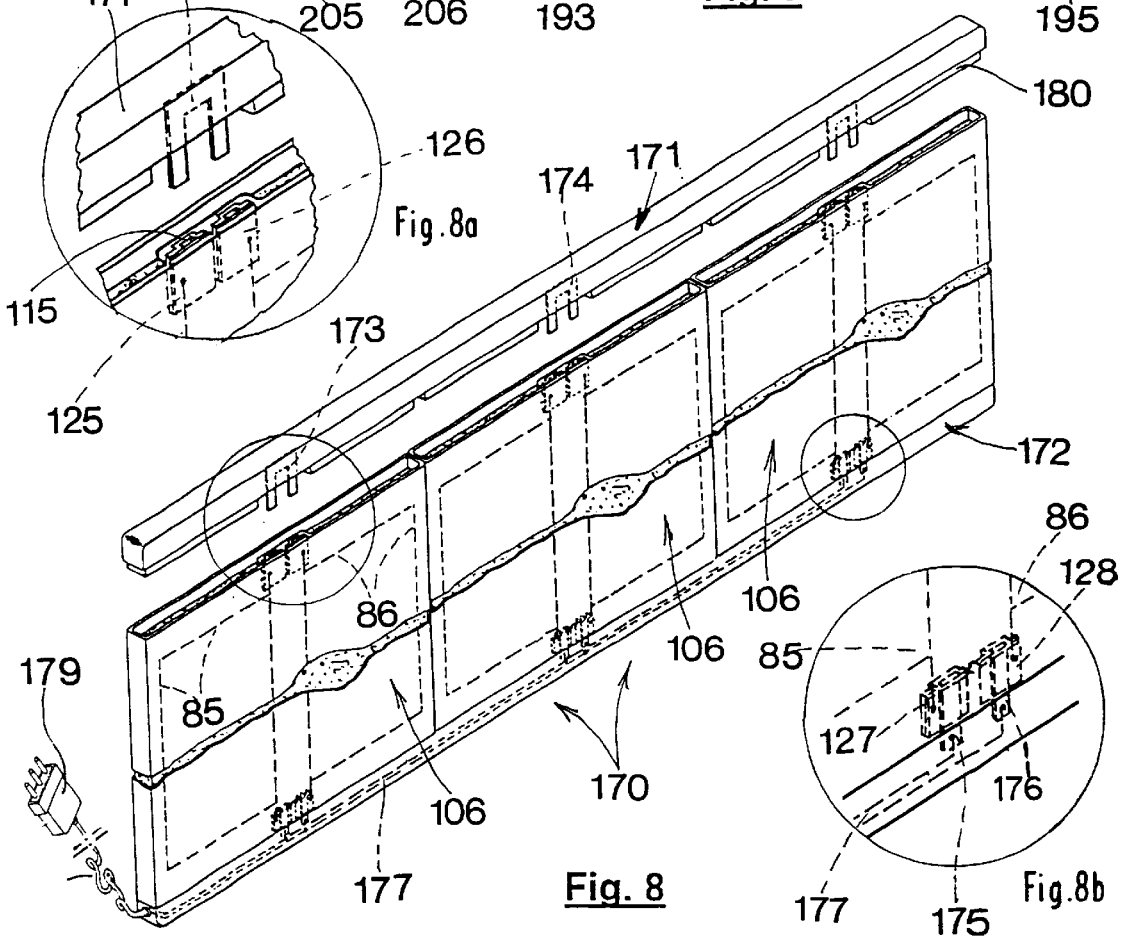
FIG. 8 Self-carrying wall generator of diffused heat, made by association of pultruded vertical oblong tubular panels, perspective.

FIG. 8 shows a self-carrying wall 170 formed of a series of poltruded tubular oblong panels 106 set vertically, placed side by side and joined at two heads, an upper head 171 and a lower one 172.

Insertion of extensions 180 in the lower part of both heads inside said panels 106 associated side by side, helps to stabilize said association and ensure electrical continuity between the electrically conductive nets 85, 86, generators of heat, that compose the panels and provide electric feed.

Head 171 presents electric bridges 173 and 174 formed of copper plugs, the dimensions of whose arms correspond to the holes 115 in sockets 125 and 126 incorporated into the panels 106.

The lower head 172 substantially similar to the upper head 171 presents a pair of electric contacts 175 and 176 so placed and sized as to penetrate inside the holes 115 in the electric sockets 127 and 128 at the other end of the panel 106.

By means of electric connections 177 and the wire 178, an electric circuit can be closed between the various panels for regular feed from the main electricity supply through the plug 179.

Figure 9:
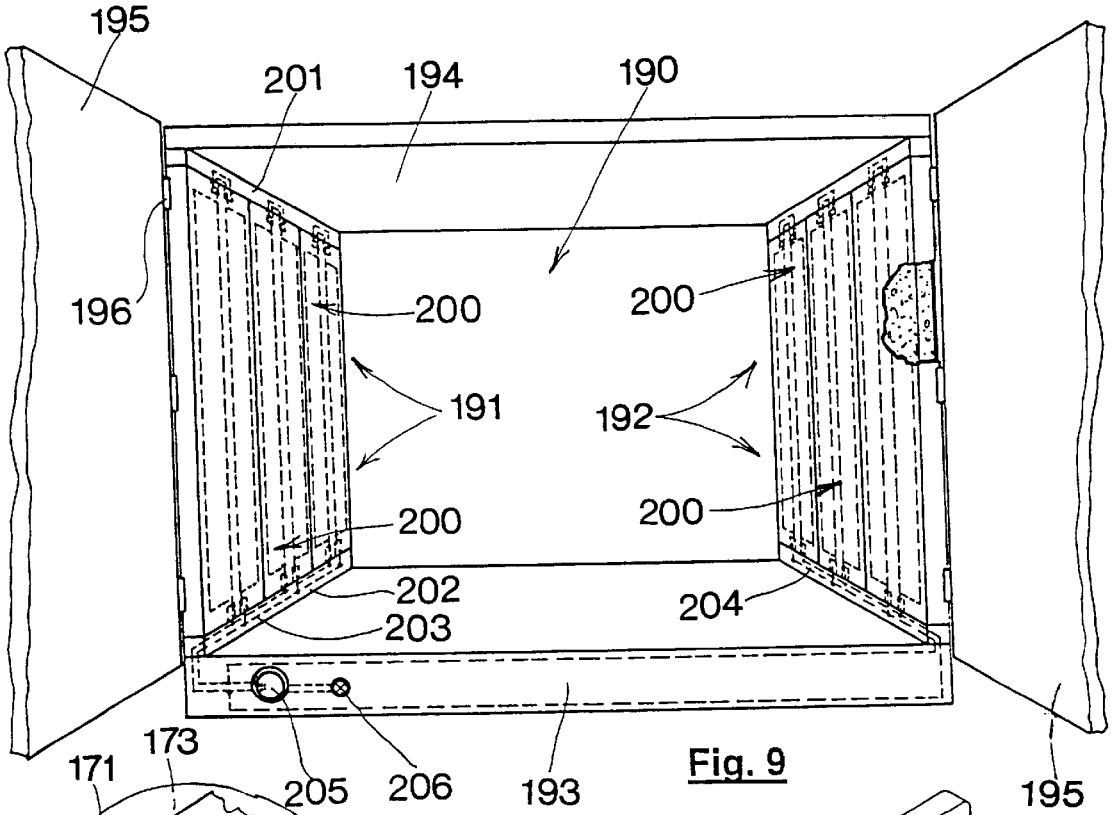
FIG. 9 Oven created by pultruded vertical tubular parts, generators of heat, perspective.

FIG. 9 shows an oven 190 for cooking or for heat treatment to various materials, formed of two side walls 191, 192, similar to the wall 170 already described, a base 193 and a roof 194.

The oven is closed by doors 195 on hinges 196.

The walls 191, 192 are formed of panels 200 complete with heads 201 and 202 similar to those described for the wall 170 in FIG. 8.

The panels are connected in parallel through conductors 203, 204 connected to the switch 205 served by a pilot light 206.

Figure 10:
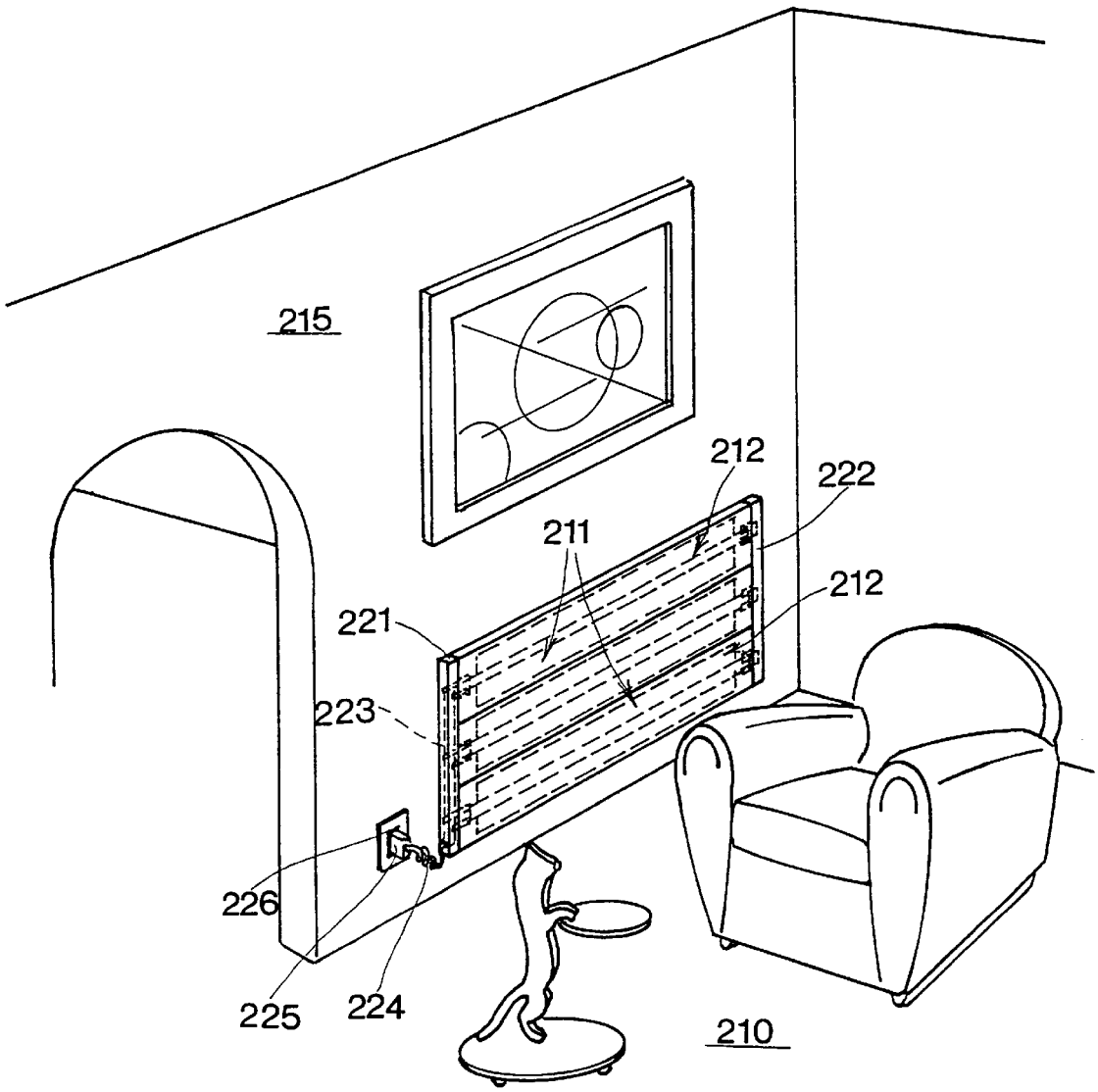
FIG. 10 Room in a house warmed by a set of horizontal pultruded tubular parts, generators of diffused heat, perspective.

FIG. 10 shows how the room 210 of a house can be warmed by a set 211 of three panels 212 substantially similar to panels 106 described above, associated by heads 221, 222 mounted on a wall 215.

The panels are electrically connected to the conductor 223 and through the wire 224 to the plug 225 for connection to the socket 226 and to main electricity supply.

The applications described, such as the self-carrying wall 170 in FIG. 8, the oven 190 in FIG. 9 and the series of panels 211 in FIG. 10 show only a few examples of an infinite number of possible applications of the pultruded tubular bodies with a rectangular cross section, comprising the electric copper nets coated with insulating paint, generators of heat, like nets 85 and 86 already described.

What is claimed is:

1. Process to form shaped pieces (105), by pultrusion, for transforming electric current into diffused heat, with reinforcing fibers (60, 65) and a matrix of plastic material (50), characterized in that one or more nets (72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein at certain intervals, devices (111, 112) for sockets incorporated in the shaped piece (105) are added to the nets for electric current and are placed longitudinally with an internal channel (115) passing through the devices (11, 112), said channel being aligned with the shaped piece (105) so that after said shaped piece (105) is cut through transversely at the position of the devices (111, 112), sockets (125–128), utilizable for connection to a source of electric current, are formed.

2. Process as in claim 1, characterized in that the shaped piece (105) is tubular.

3. Process as in claim 2, characterized in that a section of the tubular shaped piece (105) is rectangular and low in height.

4. Process as in claim 1, characterized in that the nets (72, 73) are applied to one (107) of broad surfaces (107, 108) of the shaped piece (105).

5. Process as in claim 1, characterized in that said one or more nets (72, 73) laid in one or more units, on a broad surface (107) of the shaped piece (105), present extensions (91, 92) at its sides.

6. Process as in claim 1, characterized in that there are two nets (72, 73) laid side by side.

7. Process as in claim 1, characterized in that the one or more nets (72, 73) are joined by an intermediate net of insulating material.

8. Process as in claim 1, characterized in that the nets (72, 73) are made of a weft (81) woven fabric (80).

9. Process as in claim 1, characterized in that said reinforcing fibers (60, 65) are continuous threads of fiberglass and/or pieces of fiberglass felt (65), wherein the one or more nets (72, 73) are added to the reinforcing materials,

10. Process as in claim 1, characterized in that the matrix comprises a thermosetting resin (50) of unsaturated polyester, epoxy, or phenolic resin.

11. Process as In claim 1, characterized in that the one or more nets (72, 73) are added before a resin bath.

12. Process as in claim 1, characterized in that the one or more nets (72, 73) are added before a resins bath (50) needed for pultrusion.

13. Process as in claim 1, characterized in that the devices (111, 112) for electric sockets consist of a first small flat plate (113) of electrically conductive material, said first plate (113) attached to a second small plate (114) also of electrically conductive material with an axial channel (115) open towards the first plate (113), the two plates (113, 114) being attached to one another by rivets (117).

14. Process as in claim 1, characterized in that foam material (145) is put into a panel (106, 147) (200, 212) to increase heat insulation so that a side (108) of the panel (106) opposite to a side (107) containing the electrically conductive nets (72, 73) remains substantially cold both because of its distance from said nets (72, 73) and because of the intervening foam material (145).

15. Panels (106) obtained by the process described in claim 14, characterized in that they present means (171, 172) with which to form self-carrying walls (170), one surface (107) of the panels (106) generating heat.

16. Process to form shaped pieces (105), by pultrusion, for transforming electric current into diffused heat, with reinforcing fibers (60, 65) and a matrix of plastic material (50), characterized in that one or more nets (72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein the one or more nets (72, 73) are placed continuously in the shaped part (105) but are separated in lengths (85, 86) connected by pairs of devices (111, 112) for electric sockets.

17. Process to form shaped pieces (105), by pultrusion, for transforming electric current into diffused heat, with reinforcing fibers (60, 65) and a matrix of plastic material (50), characterized in that one or more nets (72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein devices (111, 112) for electric sockets are inserted centrally in the area of the shaped piece (105) to be cut through in order to obtain oblong panels (106, 147, 200, 212) so that following said cut, each device (111, 112) forms two pairs (125, 125) (127, 128) of sockets, one pair fixed to one oblong panel (106, 147, 200, 212) and the other fixed to the next oblong panel (106, 147, 200, 212).

18. Panels (22) obtained by the process described in claim 17, characterized in that they present means (201, 202) with which to form walls (191, 192) for generating heat in an oven (190) for cooking food or for heat treatment of various materials.

19. Panels (212) obtained by the process described in claim 17, characterized in that they present means (221, 222) for forming flat bodies (211) for wall (215) or ceiling mounting, in environments (210) generally, the heat generating surface facing towards said environments.

20. Process to form shaped pieces (105), by pultrusion, for transforming electric current into diffused heat, with reinforcing fibers (60, 65) and a matrix of plastic material (50), characterized In that one or more nets (72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein devices (111, 112) for electric sockets are placed on the central axis of symmetry of the shaped piece (105).

21. Process to form shaped pieces (105), by pultrusion, for transforming electric current into diffused heat, with reinforcing fibers (60, 65) and a matrix of plastic material (50), characterized in that one or more nets (72, 73) are inserted, continuously, into the plastic material (50) said nets, consisting of a continuous wire (74) of electrically conductive material (77) coated with highly insulating material (78), being formed in The direction of feed of the shaped piece (105), thereby establishing electrical continuity from start to finish of formation of said shaped piece (105), wherein devices (111, 112) for electric sockets are placed at sides of the shape piece (105).

22. Process to form shaped pieces (105), by pultrusion, for transforming electric current into diffused heat, with reinforcing fibers (60, 65) and a matrix of plastic material (50), characterized in that one or more nets (72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein first and second nets (72, 73) are provided and wherein devices (111, 112) for electric sockets are placed as a pair (110), the first (111) and the second (112) device in each pair (110) being respectively connected to the first net (72, 73) and to the second net (72, 73).

23. Process to form shaped pieces (105), by pultrusion, for transforming electric current into diffused heat, with reinforcing fibers (60, 65) and a matrix of plastic material (50), characterized in that one or more nets.(72, 73) are inserted, continuously, into the plastic material (50) said nets, consisting of a continuous wire (74) of electrically conductive material (77) coated with highly insulating material (78), being formed in the direction of feed of the shaped piece (105), thereby establishing electrical continuity from start to finish of formation of said shaped piece (105), wherein at least one oblong panel (106, 147) is connected to electric current by means of two heads (130, 135) (150, 155) that can be respectively inserted at the two ends of said at least one panel (106, 147), one head (130, 150) having two contacts electrically connected internally to the at least one panel at a position corresponding to channels (115) in two sockets (125, 126) placed at the other end of the at least one panel (105, 147), said contacts being connected by wiring (140, 141), (160, 161) to a plug (142, 162) to fit into an outside socket for electric feed.

* * * * *